US011041513B1

(12) United States Patent
Pelini

(10) Patent No.: US 11,041,513 B1
(45) Date of Patent: Jun. 22, 2021

(54) HYDRAULIC CYLINDER ASSEMBLY

(71) Applicant: Mark F. Pelini, Valrico, FL (US)

(72) Inventor: Mark F. Pelini, Valrico, FL (US)

( * ) Notice: Subject to any disclaimer, the term of this patent is extended or adjusted under 35 U.S.C. 154(b) by 0 days.

(21) Appl. No.: 16/876,295

(22) Filed: May 18, 2020

Related U.S. Application Data

(63) Continuation-in-part of application No. 29/726,449, filed on Mar. 3, 2020, and a continuation-in-part of application No. 29/723,616, filed on Feb. 8, 2020, and a continuation-in-part of application No. 15/954,393, filed on Apr. 16, 2018, now Pat. No. 10,746,203.

(51) Int. Cl.
*F15B 15/18* (2006.01)
*F15B 1/26* (2006.01)

(52) U.S. Cl.
CPC ..... *F15B 15/18* (2013.01); *F15B 1/265* (2013.01); *F15B 2211/20515* (2013.01)

(58) Field of Classification Search
CPC ..... F03C 1/002; F03C 1/013; F03C 1/001; F03C 1/007; F03C 1/0073; F16K 17/0486; F04C 2/18; F15B 11/08; F15B 15/18; F15B 2211/20515; F15B 1/265; F15B 2211/205–2211/20592
See application file for complete search history.

(56) References Cited

U.S. PATENT DOCUMENTS

| | | | | |
|---|---|---|---|---|
| 2,918,796 | A * | 12/1959 | Weis | F16D 65/28 60/474 |
| 6,293,837 | B1 * | 9/2001 | Nakamura | B63H 20/10 440/56 |
| 6,519,939 | B1 * | 2/2003 | Duff | F15B 1/265 60/473 |
| 10,746,203 | B1 * | 8/2020 | Pelini | F04C 15/066 |
| 2010/0300279 | A1 * | 12/2010 | Kadlicko | F15B 15/18 91/361 |
| 2012/0067035 | A1 * | 3/2012 | Sweeney | F15B 15/18 60/325 |
| 2015/0135701 | A1 * | 5/2015 | Zammuto | F15B 13/01 60/464 |
| 2015/0275928 | A1 * | 10/2015 | Tsutsui | F15B 15/18 60/471 |
| 2016/0108914 | A1 * | 4/2016 | Ramadoss | F04C 15/008 417/410.4 |
| 2016/0257390 | A1 * | 9/2016 | Tsutsui | F02B 61/045 |
| 2017/0002842 | A1 * | 1/2017 | Maurer | F15B 1/265 |

* cited by examiner

*Primary Examiner* — Bryan M Lettman
(74) *Attorney, Agent, or Firm* — Edward P. Dutkiewicz

(57) ABSTRACT

A hydraulic cylinder assembly having a free-floating motor and pump, comprising a motor, and a hydraulic fluid reservoir coupled to the motor. There is a reservoir base plate having a pair of fluid path holes therein which run there through. The base plate has a mounting stud. There is a meshed gear fluid pump having a pair of downwardly directed inflow/outflow holes. The single mounting tab allows the easy placement or removal of the assembly into an operating location.

10 Claims, 11 Drawing Sheets

FIG. 5
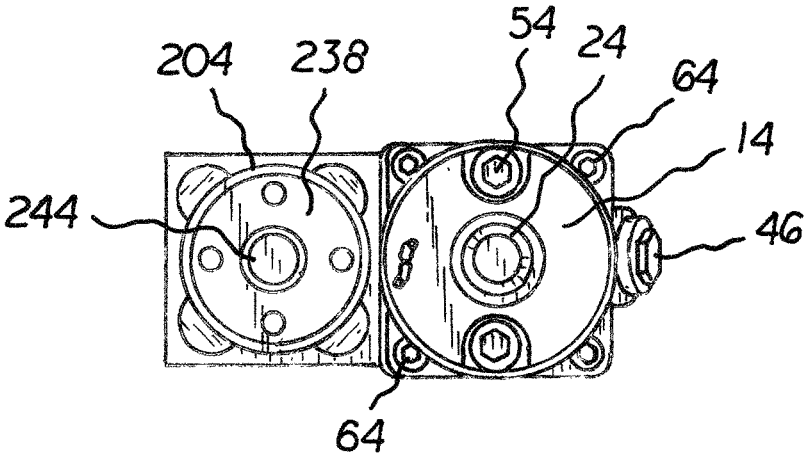
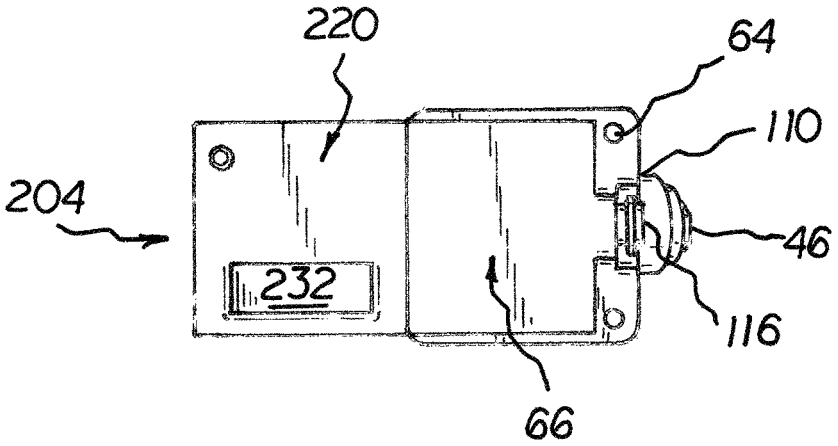
FIG. 6

FIG. 15
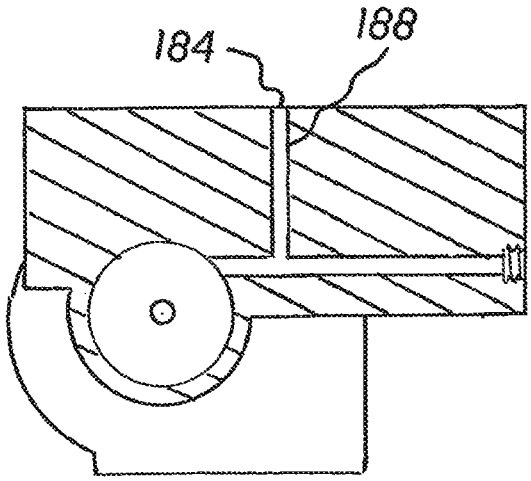
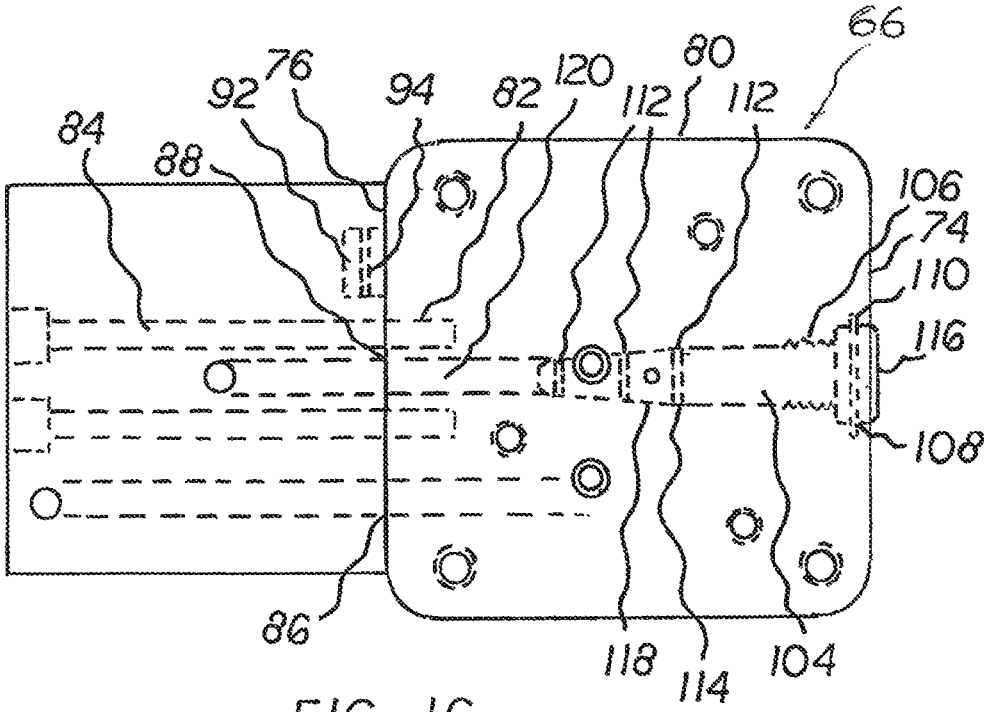
FIG. 16

HYDRAULIC CYLINDER ASSEMBLY

RULE 1.78(F)(1) DISCLOSURE

The Applicant has not submitted a related pending or patented non-provisional application within two months of the filing date of this present application. The invention is made by a single inventor, so there are no other inventors to be disclosed. This application is not under assignment to any other person or entity at this time.

This Application is a continuation-in-part of the following utility and design patent applications:

Ser. No. 15/954,393; filed on Apr. 16, 2018, currently pending;

Ser. No. 29/723,616; filed on Feb. 8, 2020, currently pending; and

Ser. No. 29/726,449; filed on Mar. 3, 2020, currently pending, and the Applicant claims the priority of each of the currently pending, above listed, patent applications.

BACKGROUND OF THE INVENTION

There is no research of development of this application which is federally sponsored.

FIELD OF THE INVENTION

The present invention relates to a Hydraulic Cylinder Assembly and more particularly pertains to an offset hydraulic pump and reservoir.

DESCRIPTION OF THE PRIOR ART

The use of electric hydraulic cylinders is known in the prior art. More specifically, electric hydraulic cylinders previously devised and utilized for the purpose of lifting purposes are known to consist basically of familiar, expected, and obvious structural configurations, notwithstanding the number of designs encompassed by the prior art which has been developed for the fulfillment of countless objectives and requirements.

While the prior art devices fulfill their respective, particular objectives and requirements, the prior art does not describe a Hydraulic Cylinder Assembly that utilizes an offset hydraulic pump and reservoir, as well as downwardly located and oriented pump fluid pickup ports, as is used in the current invention.

In this respect, the Hydraulic Cylinder Assembly, according to the present invention, substantially departs from the conventional concepts and designs of the prior art, and in doing so provides an apparatus primarily developed for the purpose of an offset hydraulic pump and reservoir.

Therefore, it can be appreciated that there exists a continuing need for a new and improved Hydraulic Cylinder Assembly which can be used for lifting which has an offset hydraulic pump and reservoir. In this regard, the present invention substantially fulfills this need.

SUMMARY OF THE INVENTION

In view of the foregoing disadvantages inherent in the known types of electric hydraulic cylinders now present in the prior art, the present invention provides an improved Hydraulic Cylinder Assembly. As such, the general purpose of the present invention, which will be described subsequently in greater detail, is to provide a new and improved Hydraulic Cylinder Assembly which has all the advantages of the prior art and none of the disadvantages.

In describing this invention, the word "coupled" is used. By "coupled" is meant that the article or structure referred to is joined, either directly, or indirectly, to another article or structure. By "indirectly joined" is meant that there may be an intervening article or structure imposed between the two articles which are "coupled". "Directly joined" means that the two articles or structures are in contact with one another or are essentially continuous with one another.

By adjacent to a structure is meant that the location is near the identified structure.

To attain this, the present invention essentially comprises a A hydraulic cylinder assembly having a free-floating motor and pump is herein described. The hydraulic cylinder assembly has a free-floating motor and pump comprises several components, in combination First there is a motor. The motor has a housing, with the housing having an upper extent and a lower extent. The motor housing has a pair of mounting bolt holes there through. The motor has an output shaft, with the output shaft having an upper end and a lower end. The lower end of the motor output shaft has a hexagonally shaped recess therein.

There is a power source which is operatively coupled to the motor.

There is a hydraulic fluid reservoir. The hydraulic fluid reservoir has a front wall, a rear wall, a right side wall, and a left side wall. The front wall is continuous with the right side wall and the left side wall. The rear wall is continuous with the left side wall and the right side wall. The walls collectively form a fluid holding volume therein. The right side wall has a fill plug opening, with the fill plug opening having an associated fill plug.

The hydraulic fluid reservoir has an open upper end with an upper flange. The upper flange of the hydraulic fluid reservoir has a pair of threaded motor mounting bolt holes there in. The upper flange of the hydraulic fluid reservoir has a pair of motor mounting bolts, which pass through the motor housing, and couple the motor to the upper flange of the hydraulic fluid reservoir.

The hydraulic fluid reservoir has an open lower end, with the lower end of the hydraulic fluid reservoir having a lower flange. The lower flange of the hydraulic fluid reservoir has four corners, with each of the four corners of the hydraulic fluid reservoir lower flange having an attachment bolt hole there through. Each hydraulic fluid reservoir lower flange bolt hole has an associated lower flange bolt.

There is a cylinder mounted reservoir base plate which has a generally rectilinear configuration. The cylinder mounted reservoir base plate has an upper surface and lower surface, with a thickness there between. The thickness of the cylinder mounter reservoir base plate forms a peripheral edge. The peripheral edge of the cylinder mounted reservoir base plate has a outward right side, an inward left side, a front side, and a rear side. The inward left side of the cylinder mounter reservoir base plate has a pair of threaded bolt holes there in, with a pair of associated cylinder mounting bolts.

The inward left side of the base plate has a pair of fluid path holes therein, being a first fluid path hole and a second fluid path hole. The first fluid path hole is continuous with a base plate first fluid path. The second fluid path hole is continuous with a base plate second fluid path. Each fluid path hole has an associated o ring. The inward left side of the base plate has a mounting stud protruding from a mounting stud hole in the base plate. The mounting stud has an associated o ring. The base plate has four threaded mounting bolt holes there through. The four threaded mounting bolt holes are sized to threadedly receive each of the four lower flange bolts. The base plate threaded mounting holes run from the upper surface of the reservoir base plate to the lower surface of the reservoir base plate.

The reservoir base plate has a flow regulator hole there through. The flow regulator hole runs through the reservoir base plate from the outward right side of the base plate to the inward left side of the base plate. The flow regulator hole commences at the outward right side of the base plate and has a partially threaded first internal dimension. The flow regulator hole also has a tapered section. The flow regulator hole has a second internal dimension, with the second internal dimension being less than the first internal dimension.

The taper of the flow regulator hole is continuous from the first internal dimension to the second internal dimension. The flow regulator hole runs through the base plate from the outward right side of the base plate to the inward left side of the base plate. The inward left side flow regulator hole has the second internal dimension.

The flow regulator hole of the reservoir base has an associated flow regulator. The flow regulator has a threaded outward end, with retention clip groove, having an associated retention clip. The flow regulator has a plurality of o ring grooves, with associated o rings. The flow regulator has a right outward end having a first external dimension with a thread. The first external dimension thread of the flow regulator being sized to mate with and be threadedly received within the right outward end thread of the flow regulator hole. The flow regulator has a middle section, with the middle section having an external diameter configured as a taper, with the taper of the middle section sized to fit within the taper internal dimension of the flow regulator hole. The flow regulator hole has an inward left end which has a second internal dimension. The second external dimension of the flow regulator is sized to fit within the second internal dimension of the flow regulator hole. The second external dimension of the flow regulator is less than the first external dimension of the flow regulator.

The base plate first fluid path runs from the upper surface of the base plate to the left inward surface of the base plate, thereby forming the first fluid path hole of the left inward surface end of the base plate, being the base plate first fluid path hole. The base plate first fluid path hole which is located on the left inward surface end of the base plate has an o ring groove with an associated o ring. The base plate second fluid path runs from the upper surface of the base plate to the left inward surface of the base plate, thereby forming the base plate second fluid path hole which is located on the left inward surface end of the base plate. The base plate second fluid path hole, which is located on the left inward surface end of the base plate, has an o ring groove with an associated o ring. The second fluid path meets and joins the flow regulator hole, which allows the regulation of fluid flow.

There is a fluid pump. The fluid pump has an upper component and a lower component. The upper component has an upper surface and a lower surface, with a thickness there between. The fluid pump upper component has a plurality of coupling bolt holes there through. The fluid pump upper component has a pair of gear shaft holes there through.

The lower surface of the fluid pump upper component has a pair of overlapping gear recesses. The gear recesses each have an intersecting portion.

The lower surface of the fluid pump upper component has a pair of fluid grooves. The fluid grooves of the fluid pump upper component lower surface connect to the intersection portion of the gear recesses of the fluid pump upper component lower surface and to the first fluid path pickup and delivery hole and the second fluid path pickup and delivery hole.

The fluid pump lower component has an upper surface and a lower surface, with a thickness there between. The thickness of the fluid pump lower component forms four side edges, being a right side edge, a left side edge, a forward edge, and a rearward edge. The fluid pump lower component forward edge and the fluid pump lower component rearward edge each have a communicating fluid shuttle valve hole there through. The fluid shuttle valve hole has a stepped configuration. The fluid shuttle valve hole has an associated fluid shuttle valve, with a pair of fluid shuttle valve hole end plugs. The fluid shuttle valve comprises a pair of opposed springs, a pair of opposed needle valves, a pair of opposed shuttle valve seats, and a centrally located shuttle. Each of the fluid shuttle valve hole end plugs has a slot therein. Each fluid shuttle valve hole end plug has an associated o ring.

The fluid pump lower component has a plurality of threaded coupling bolt holes there through. Each of the threaded coupling bolt holes of the fluid pump lower component have an associated coupling bolt. The fluid pump lower component has a pair of gear shaft holes there through. The lower surface of the fluid pump upper component has a plurality of base plate mounting bolt holes there through.

The fluid pump lower component has a pair of ball check valves comprising a ball seat and a ball, for permitting one way flow of fluid, at a time, through the pump. The check valves are located in the fluid pickup and delivery holes. This allows fluid to be drawn into the pump, or pressured from the reservoir into the pump, via the fluid pickup and delivery holes, with the check valves only permitting fluid to enter the pump when the fluid pressure within the reservoir is either greater than or equal to the pressure within the pump, so as to prevent cavitation on the feed side of the gear combination. When the pump pressure increases on one side of the pump gears, the check valve on that side of the pump is pressurized and forced closed. If, on the other side of the pump, the fluid is pulled away from the gears, and the pressure on that side of the gears is lower than the reservoir pressure, such as is present in cavitation, the check valve is pulled open, and fluid enters the pump from the reservoir through the fluid pickup and delivery holes. The check valves restrict fluid movement, but not air movement, as when the air is being bled from the fluid passageways. In this instance such as occurs during bleeding, air, which returns through the fluid paths is allowed to exit the pump through the fluid pickup holes.

The upper surface of the fluid pump lower component has a pair of lower component shuttle valve delivery fluid path holes there in, with each lower component shuttle valve delivery fluid path hole having an associated linear recess. Each of the lower component shuttle valve delivery fluid path holes is continuous with one of the pair of fluid pump lower component shuttle valve delivery fluid paths. The fluid pump lower component shuttle valve delivery fluid paths, being the lower component first shuttle valve delivery fluid path and the lower component second shuttle valve delivery fluid path, run from the lower component upper surface to the lower component lower surface and are downwardly directed into the shuttle valve hole, and shuttle valve.

The fluid path holes of the lower component upper surface communicate through the lower component first fluid path and the lower component second fluid path with the shuttle valve hole. The fluid pump lower component lower surface has a pair of fluid path holes, being a fluid pump lower component lower surface first fluid path hole and a fluid pump lower component lower surface second fluid path hole, with the fluid path holes of the fluid pump lower component lower surface communicating with the shuttle valve hole.

The fluid pump lower component lower surface fluid path holes are directed in a downward orientation, taking fluid from, and returning fluid to, the shuttle valve. Each of the fluid path holes of the fluid pump lower component lower surface have an associated o ring.

The fluid pump has a pair of rotatably interlocking pump gears. The pump gears each have a central shaft. The central shaft of each of the pump gears being rotatably contained with the gear shaft holes of the fluid pump upper component and the gear shaft holes of the fluid pump lower component. the fluid pump interlocking pump gears are each contained within one of the overlapping gear recesses of the lower surface of the fluid pump upper component. Each central shaft of the interlocking pump gears have a hexagonally configured shaft hole there through. The fluid pump has a hexagonally shaped drive shaft. The drive shaft couples one of the interlocking pump gears with the motor output shaft.

There is a hydraulic cylinder. The hydraulic cylinder has an upper end, with an open upper extent, and a closed lower end with a piston passageway bottom. The hydraulic cylinder open upper end has an internal thread. The hydraulic cylinder piston passageway is round and is continuous, running from the open upper extent of the hydraulic cylinder to the closed lower end bottom of the hydraulic cylinder.

The hydraulic cylinder piston passageway has an upper region. The closed lower end bottom of the hydraulic cylinder forms a solid cylinder base. The hydraulic cylinder has a piston passageway wall, with the wall having a length. The piston passageway wall of the hydraulic cylinder has an upper end fluid passageway there in. The upper end fluid passageway runs from a fluid passageway opening, which is located in the upper region of the hydraulic cylinder piston passageway, to the cylinder base of the hydraulic cylinder, thereby forming a cylinder base opening, where the upper end fluid passageway is operatively coupled to the first fluid path hole of the inward left side of the cylinder mounted reservoir base plate.

The piston passageway of the hydraulic cylinder has a lower end fluid passageway there in, with the lower end fluid passageway running from the bottom of the hydraulic cylinder piston passageway to the cylinder base of the hydraulic cylinder, where the lower end fluid passageway is operatively coupled to the second fluid path hole of the inward left side of the cylinder mounted reservoir base plate. The cylinder base has a single downwardly projected mounting tab with a bolt hole there through. The cylinder base has a pair of reservoir base plate mounting bolt holes which run there through, for coupling the hydraulic cylinder to the cylinder mounted reservoir base plate. The hydraulic cylinder reservoir base plate mounting bolt holes are sized to receive the cylinder mounting bolts.

The hydraulic cylinder has an end cap. The end cap has an aperture there through. The end cap has an external thread which is sized to be threadedly received by the internal thread of the hydraulic cylinder open upper end. The hydraulic cylinder has an associated ram shaft. The hydraulic cylinder ram shaft has a lower end with an associated piston coupled thereto. The hydraulic cylinder piston has an associated o ring. The ram shaft passes through the aperture of the end cap. The ram shaft has an upper end with a mounting hole there through.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention.

It is important, therefore, that the claims be regarded as including such equivalent constructions insofar as they do not depart from the spirit and scope of the present invention.

It is therefore an object of the present invention to provide a new and improved Hydraulic Cylinder Assembly which has all of the advantages of the prior art electric hydraulic cylinders and none of the disadvantages.

It is another object of the present invention to provide a new and improved Hydraulic Cylinder Assembly which may be easily and efficiently manufactured and marketed.

It is further object of the present invention to provide a new and improved Hydraulic Cylinder Assembly which is of durable and reliable constructions.

An even further object of the present invention is to provide a new and improved Hydraulic Cylinder Assembly which is susceptible of a low cost of manufacture with regard to both materials and labor, and which accordingly is then susceptible of low prices of sale to the consuming public, thereby making such Hydraulic Cylinder Assembly economically available to the buying public.

Even still another object of the present invention is to provide a Hydraulic Cylinder Assembly having an offset hydraulic pump and reservoir.

Lastly, it is an object of the present invention to provide a new and improved Hydraulic Cylinder Assembly having a free-floating motor and pump, comprising a motor, and a hydraulic fluid reservoir coupled to the motor.

There is a reservoir base plate having a pair of fluid path holes therein which run there through. The base plate has a mounting stud. There is an intermeshed gear fluid pump having a pair of downwardly directed inflow/outflow holes. The single mounting tab allows the easy placement or removal of the assembly into an operating location.

It should be understood that while the above-stated objects are goals which are sought to be achieved, such objects should not be construed as limiting or diminishing the scope of the claims herein made.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 is a top plan view of the invention;

FIG. 6 is a bottom plan view of the invention;

FIG. 15 is a view taken along line 15-15 of FIG. 11;

FIG. 16 is a view taken along line 16-16 of FIG. 8 with the flow regulator hole and the fluid passageways, first and second fluid passageways being shown in phantom. Also shown in phantom are the bolt holes for coupling the cylinder to the base plate;

The same reference numerals refer to the same parts throughout the various Figures.

DESCRIPTION OF THE PREFERRED EMBODIMENT

Figure 1:
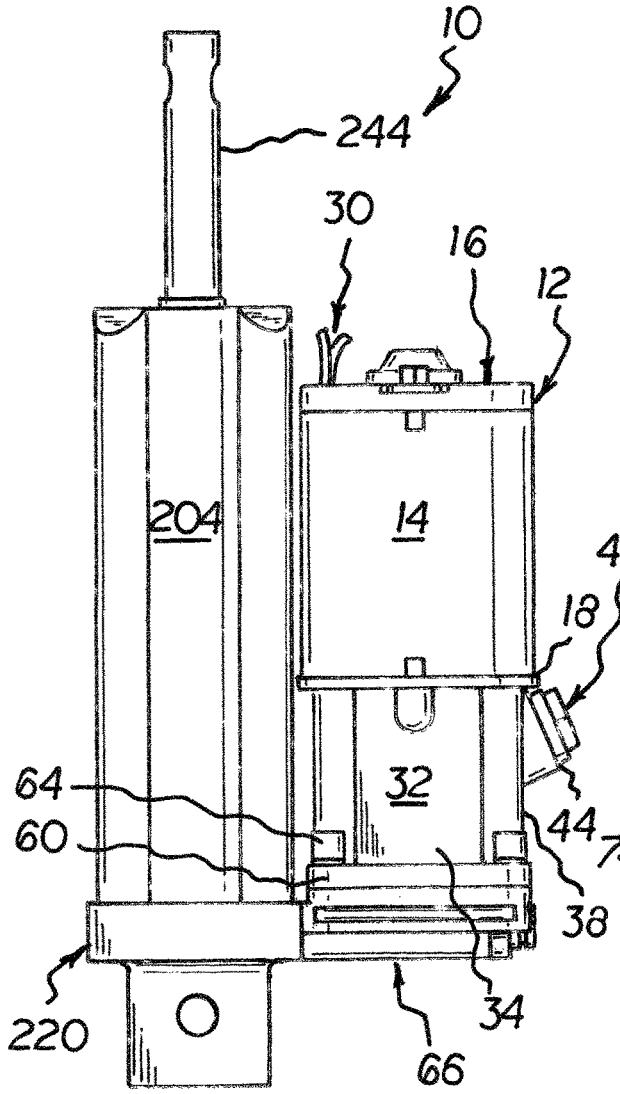
FIG. 1 is front plan view of the Hydraulic Cylinder Assembly.
Figure 2:
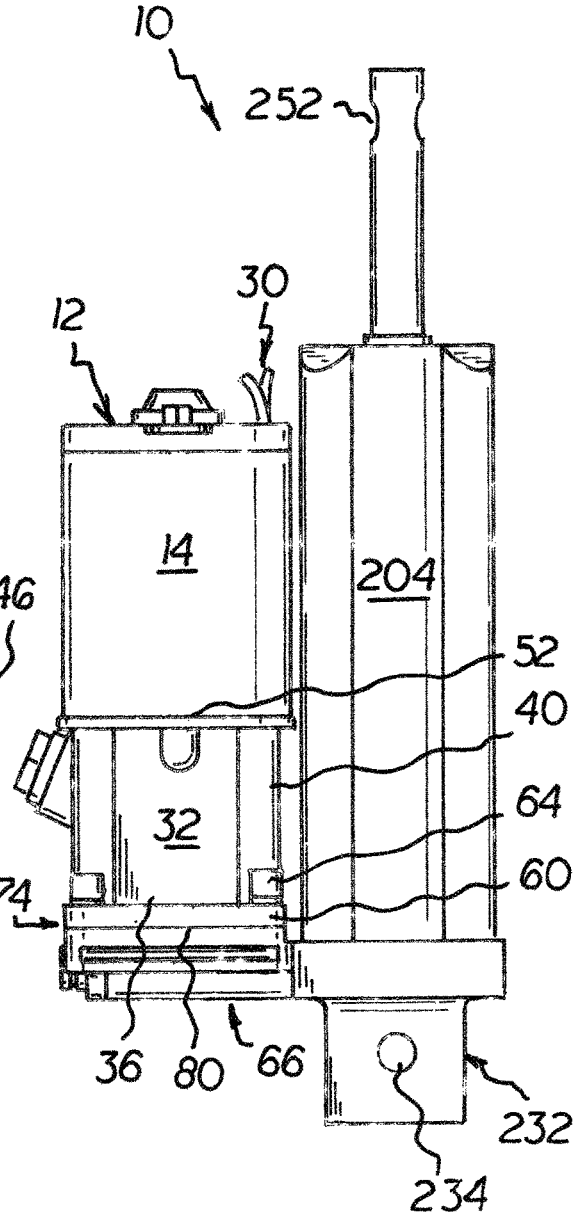
FIG. 2 is a rear plan view of the invention.
Figure 3:
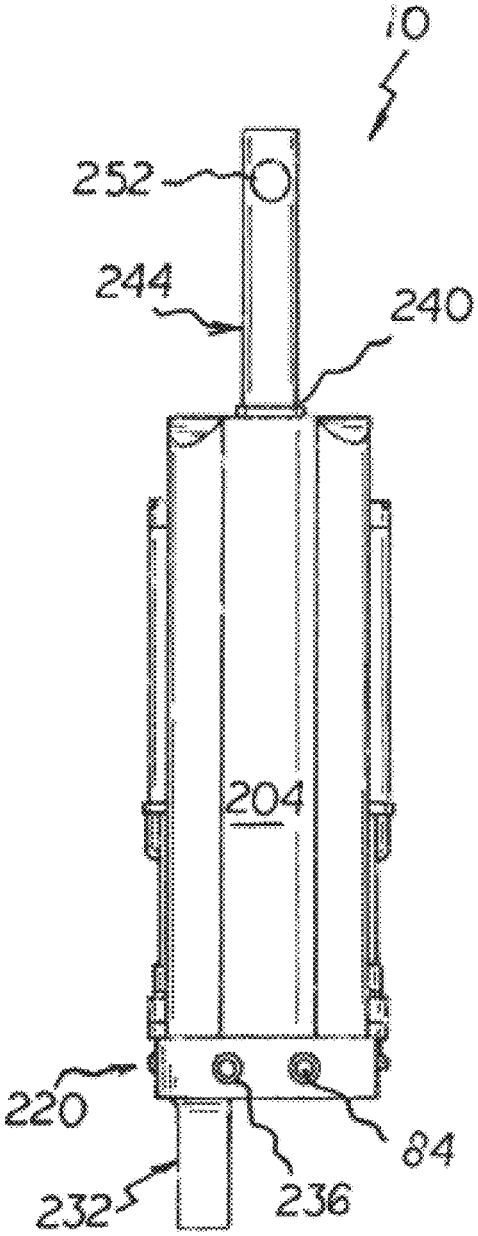
FIG. 3 is a left side plan view of the invention.
Figure 4:
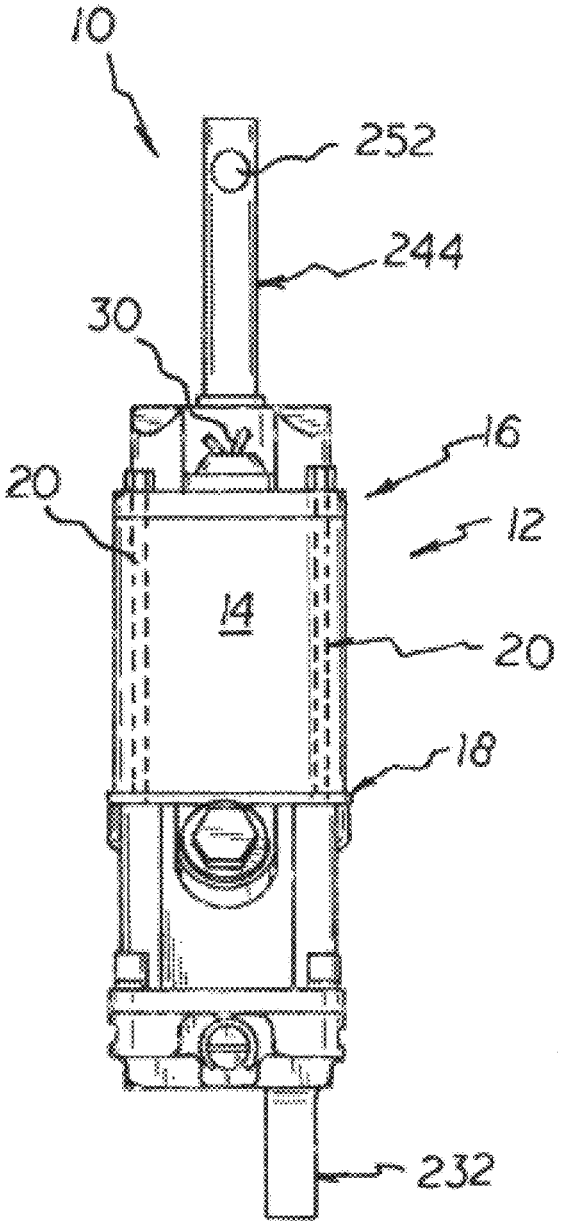
FIG. 4 is a right side plan view of the invention with the bolts holding the motor to the reservoir being shown in phantom.
Figure 7:
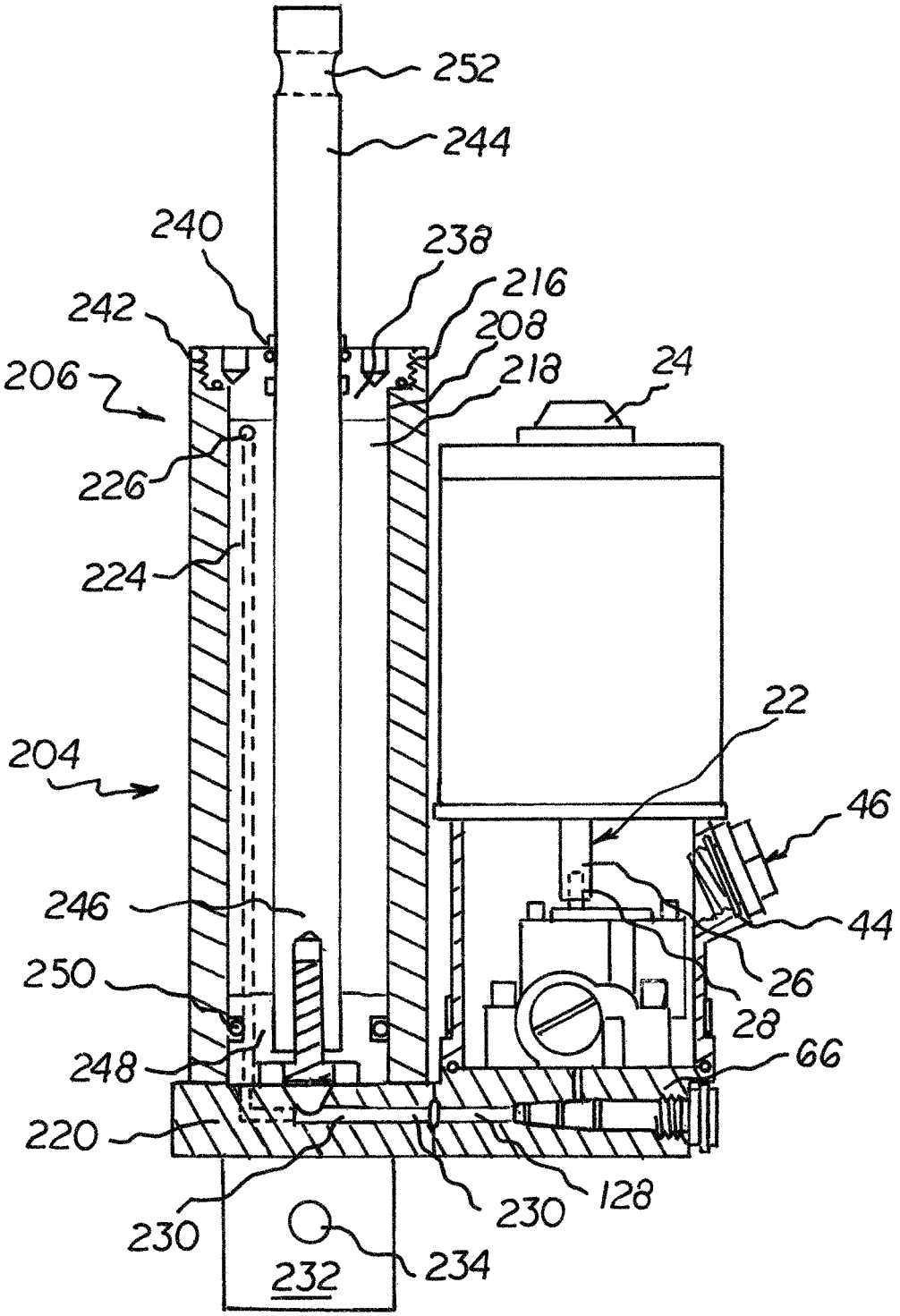
FIG. 7 is a cut away view showing the internal components of the Hydraulic Cylinder Assembly.
Figure 8:
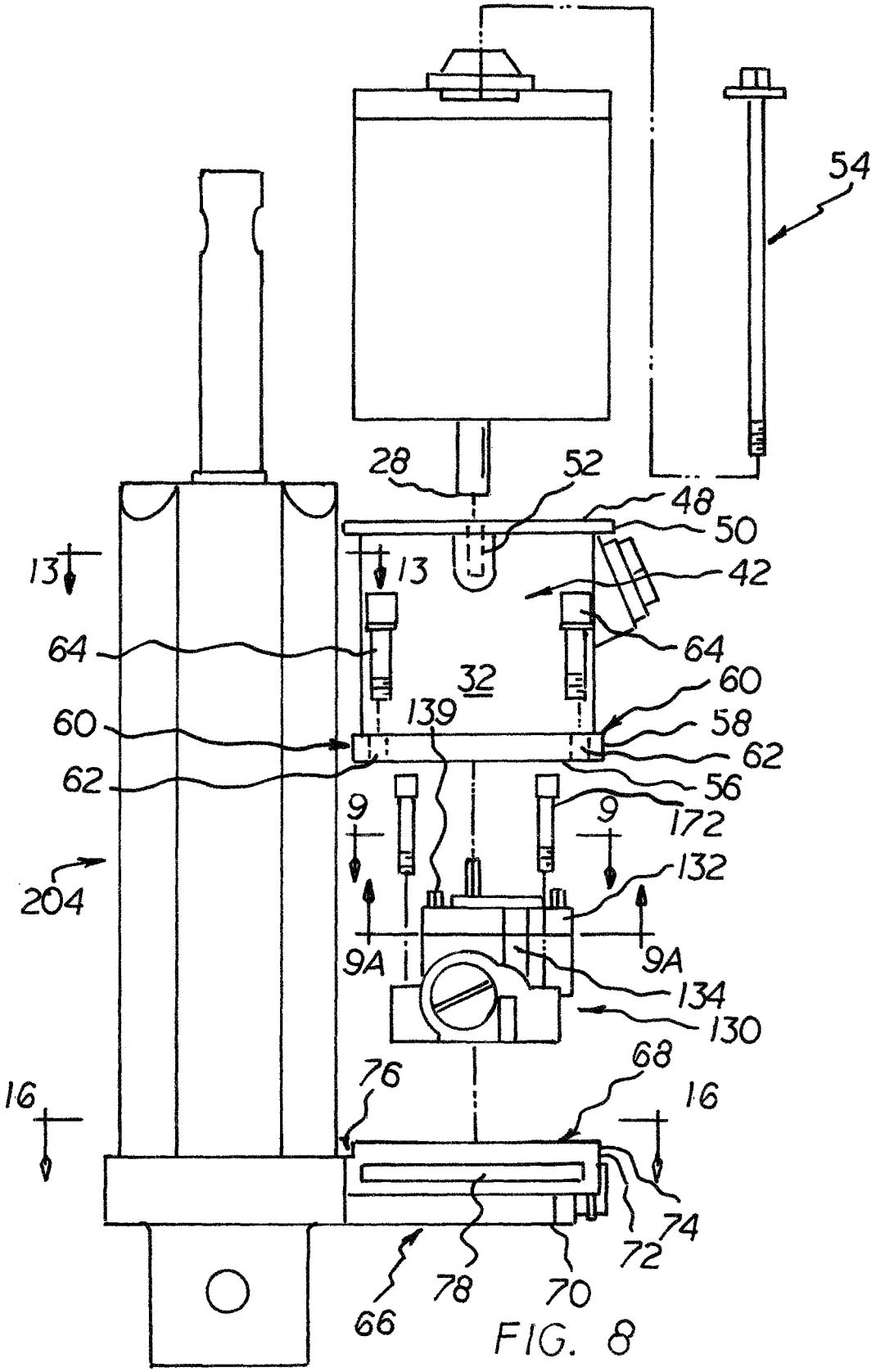
FIG. 8 is an exploded view of the components of the invention.
Figure 9:
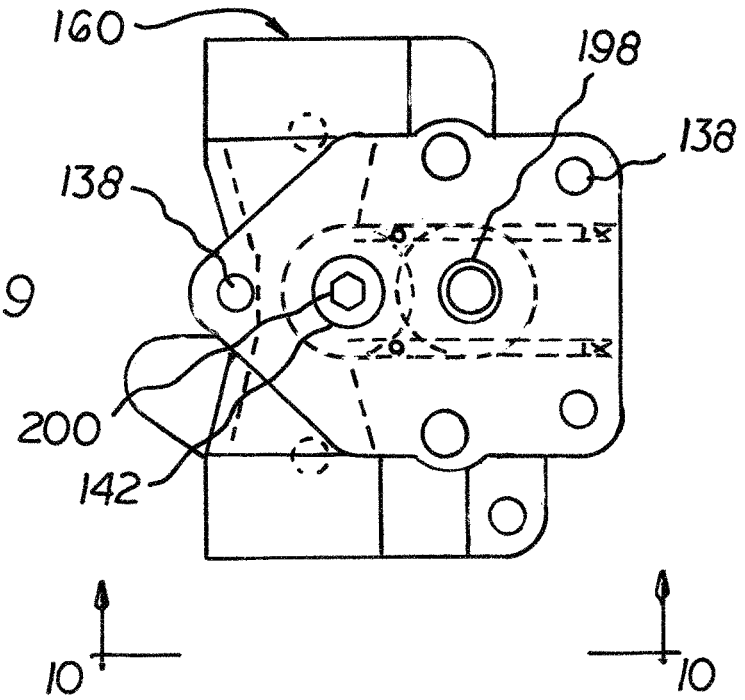
FIG. 9 is a view taken along line 9-9 of FIG. 8.
Figure 10:
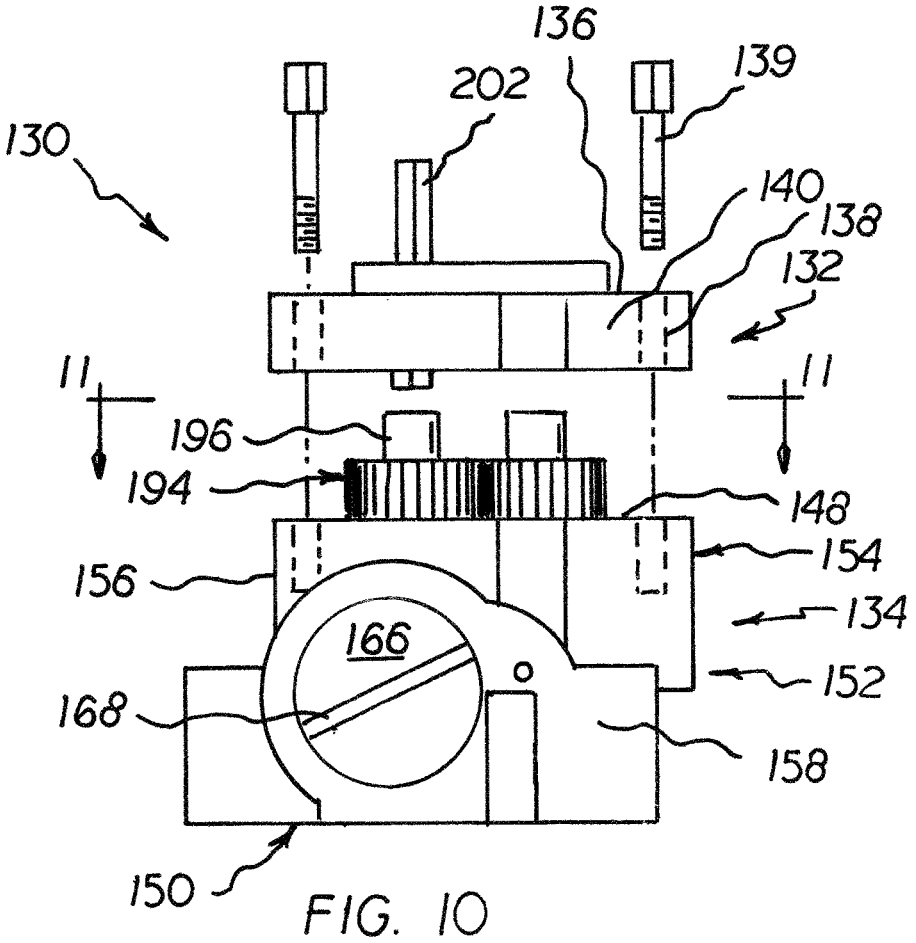
FIG. 10 is a view taken along line 10-10 of FIG. 9A with the bolt holes and threaded bolt holes for coupling the upper and lower pump components, being shown in phantom.
Figure 9A:
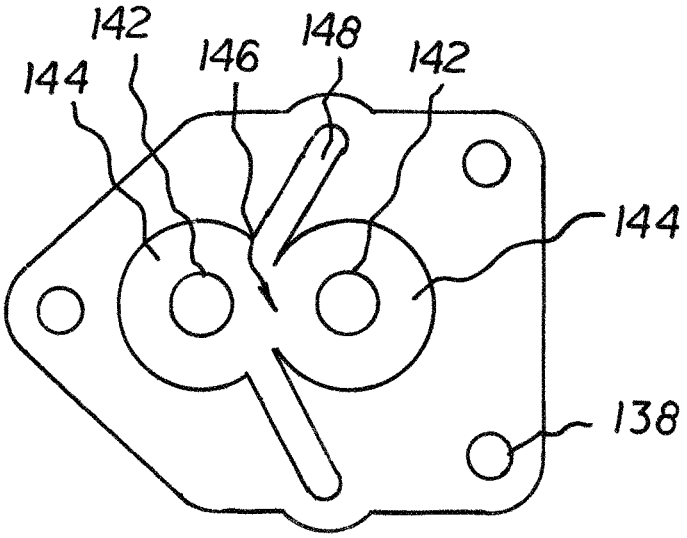
FIG. 9A is a view taken along line 9A-9A of FIG. 8 with the fluid pathways and the shuttle valve hole being shown in phantom.
Figure 11:
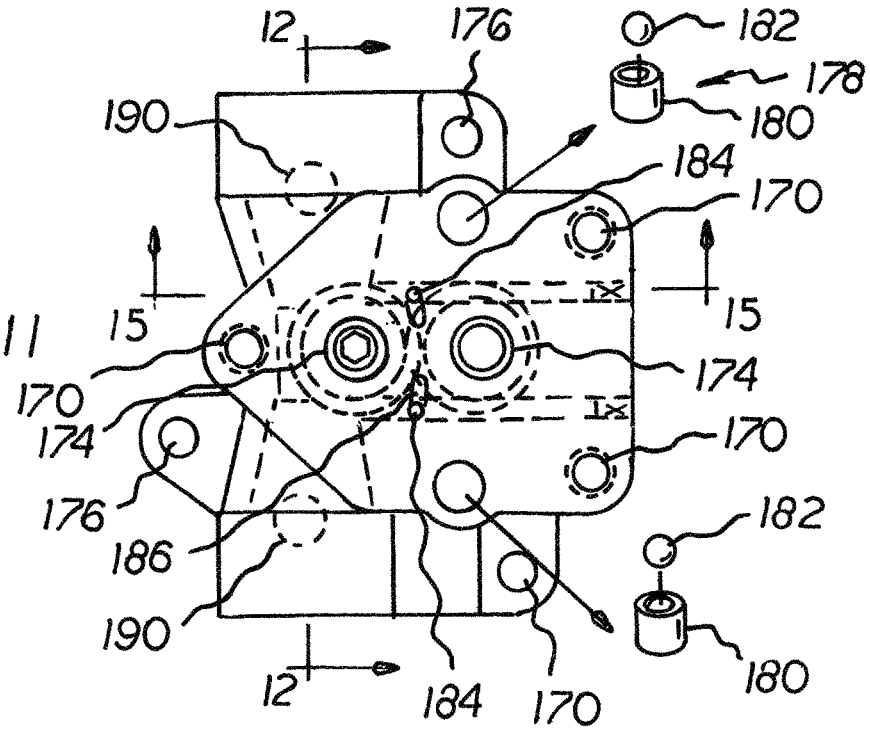
FIG. 11 is a view taken along line 11-11 of FIG. 10 with the shuttle hole and fluid passageways being shown in phantom. Note the drill holes from the right side, which are plugged after connecting the fluid pathways.
Figure 12:
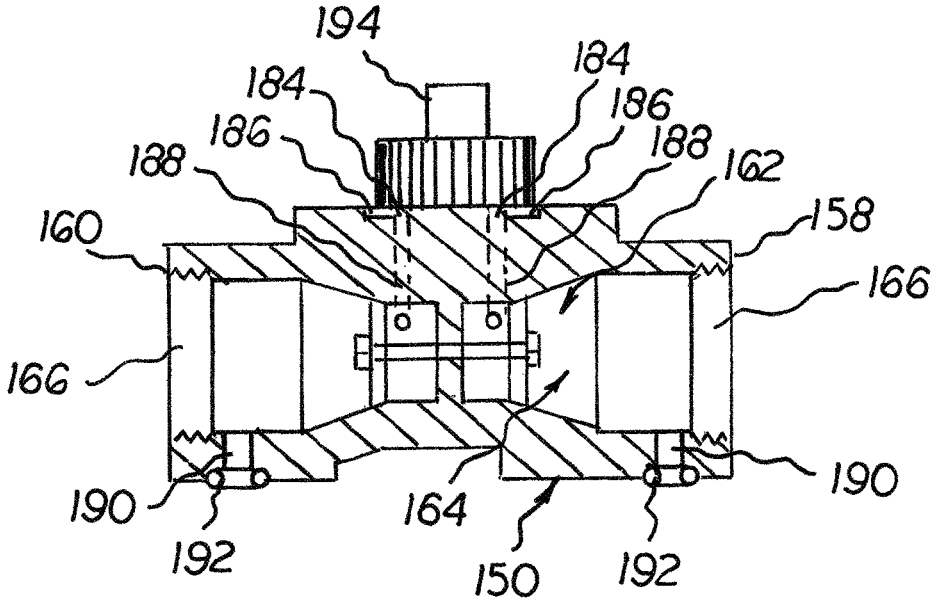
FIG. 12 is a view taken along line 12-12 of FIG. 11 with the fluid pathways being shown in phantom wherein the fluid leaves the area of the gears and is pushed downward into the shuttle valve hole.
Figure 13:
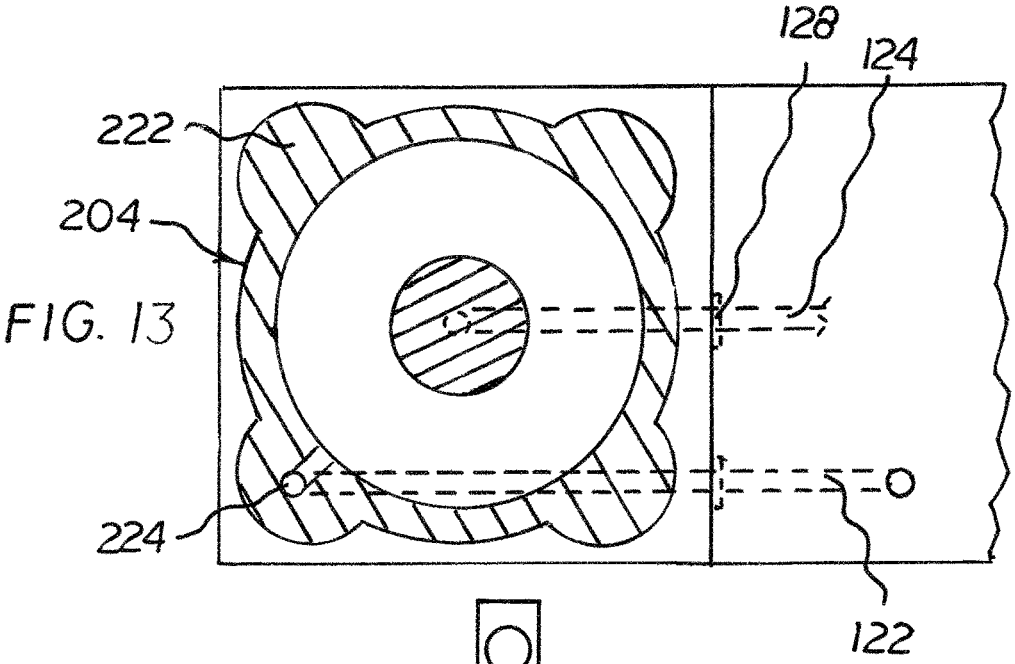
FIG. 13 is a view taken along line 13-13 of FIG. 8 with the fluid pathways of the hydraulic cylinder being shown in phantom, along with part of the base plate so as to show the continuous relationship of the fluid passageways through those elements of the assembly.
Figure 14:
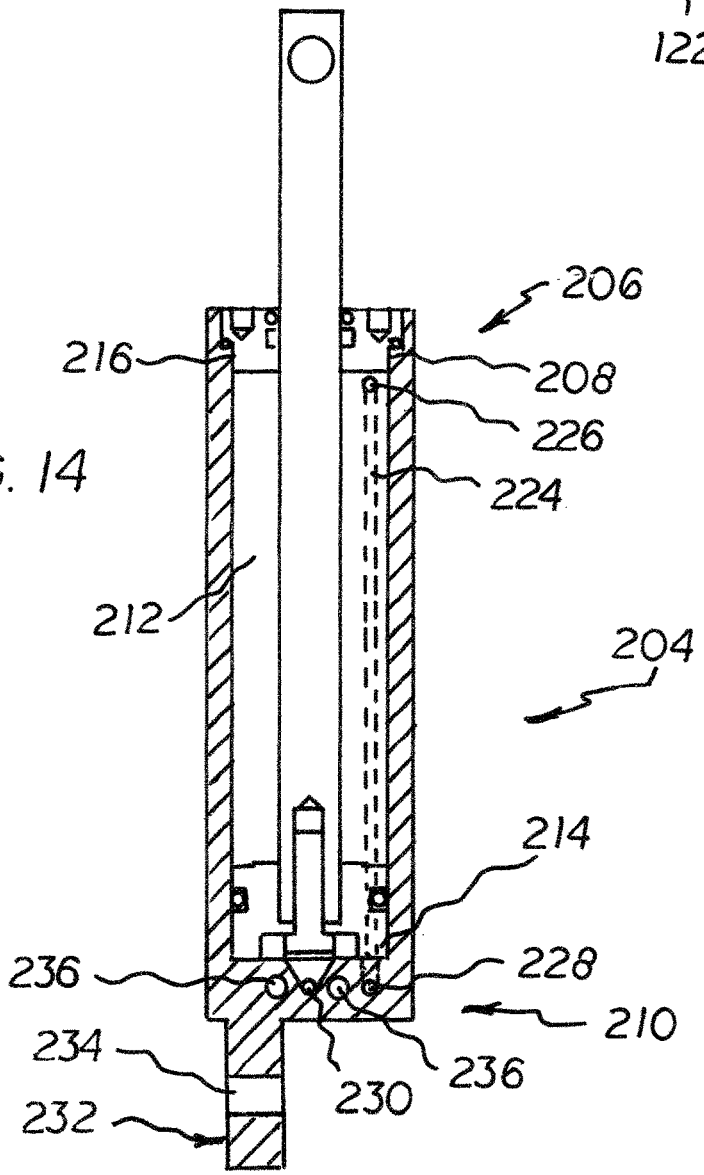
FIG. 14 is a cross section of the hydraulic cylinder.
Figure 17:
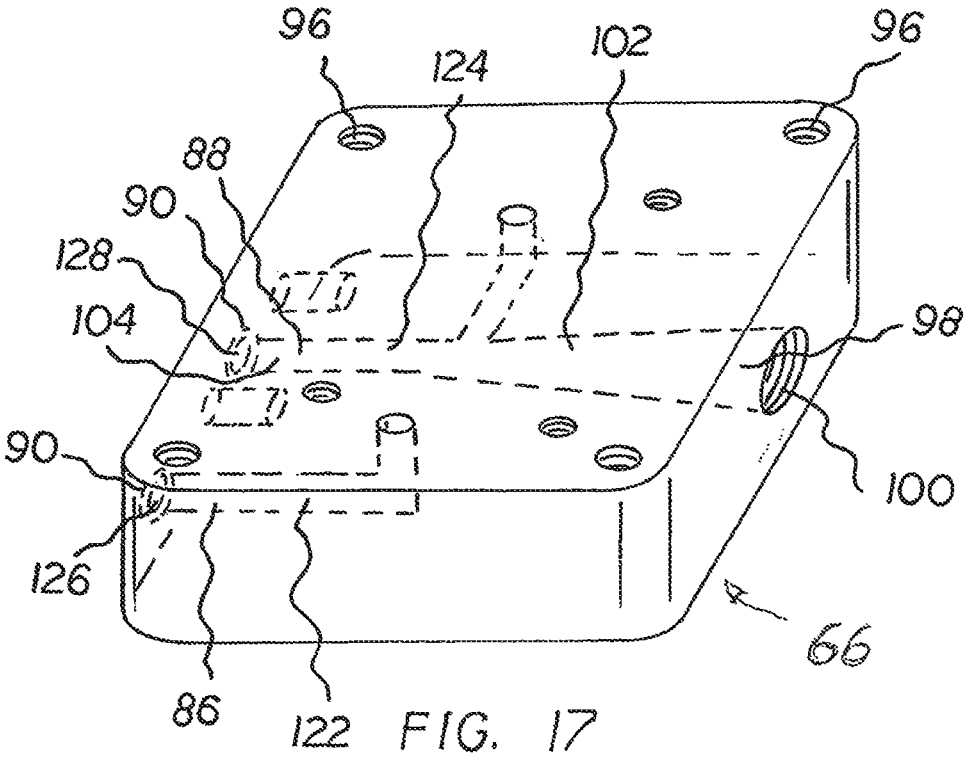
FIG. 17 is a perspective view of the base plate with fluid passageways and flow regulator hole being shown in phantom.

With reference now to the drawings, and in particular to FIG. 1 thereof, the preferred embodiment of the new and improved Hydraulic Cylinder Assembly embodying the principles and concepts of the present invention and generally designated by the reference numeral 10 will be described.

The present invention, the Hydraulic Cylinder Assembly 10 is comprised of a plurality of components. Such components in their broadest context include a motor, a reservoir, a fluid pump and a hydraulic cylinder. Such components are individually configured and correlated with respect to each other so as to attain the desired objective.

A hydraulic cylinder assembly having a free-floating motor and pump 10 is herein described. The hydraulic cylinder assembly having a free-floating motor and pump comprises several components, in combination First there is a motor 12. The motor has a housing 14, with the housing having an upper extent 16 and a lower extent 18. The motor housing has a pair of mounting bolt holes 20 there through. The motor has an output shaft 22, with the output shaft having an upper end 24 and a lower end 26. The lower end of the motor output shaft has a hexagonally shaped recess 28 therein.

There is a power source 30 which is operatively coupled to the motor.

There is a hydraulic fluid reservoir 32. The hydraulic fluid reservoir has a front wall 34, a rear wall 36, a right side wall, and a left side wall 40. The front wall is continuous with the right side wall and the left side wall. The rear wall is continuous with the left side wall and the right side wall. The walls collectively form a fluid holding volume 42 therein. The right side wall has a fill plug opening 44, with the fill plug opening having an associated fill plug 46.

The hydraulic fluid reservoir has an open upper end 48 with an upper flange 50. The upper flange of the hydraulic fluid reservoir has a pair of threaded motor mounting bolt holes 52 there in. The upper flange of the hydraulic fluid reservoir has a pair of motor mounting bolts 54, which pass through the motor housing, and couple the motor to the upper flange of the hydraulic fluid reservoir.

The hydraulic fluid reservoir has an open lower end 56, with the lower end of the hydraulic fluid reservoir having a lower flange 58. The lower flange of the hydraulic fluid reservoir has four corners 60, with each of the four corners of the hydraulic fluid reservoir lower flange having an attachment bolt hole there through 62. Each hydraulic fluid reservoir lower flange bolt hole has an associated lower flange bolt 64.

There is a cylinder mounted reservoir base plate 66 which has a generally rectilinear configuration. The cylinder mounted reservoir base plate has an upper surface 68 and lower surface 70, with a thickness there between. The thickness of the cylinder mounter reservoir base plate forms a peripheral edge 72. The peripheral edge of the cylinder mounted reservoir base plate has a outward right side 74, an inward left side 76, a front side 78, and a rear side 80. The inward left side of the cylinder mounter reservoir base plate has a pair of threaded bolt holes 82 there in, with a pair of associated cylinder mounting bolts 84.

The inward left side has a pair of fluid path holes therein, being a first fluid path hole 86 and a second fluid path hole 88. Each fluid path hole has an associated o ring 90. The inward left side of the base plate 66 has a mounting stud 92 protruding from a mounting stud hole in the base plate 66. The mounting stud 92 has an associated o ring 94.

The base plate 66 has four threaded mounting bolt holes 96 there through. The four threaded mounting bolt holes are sized to threadedly receive each of the four lower flange bolts. The base plate 66 threaded mounting holes 96 run from the upper surface of the reservoir base plate 68 to the lower surface of the reservoir base plate 70.

The reservoir base plate 66 has a flow regulator hole 98 there through. The flow regulator hole 98 runs through the reservoir base plate from the outward right side of the base plate 74 to the inward left side of the base plate 76. The flow regulator hole 98 commences at the outward right side of the base plate 74 and has a partially threaded first internal dimension 100. The flow regulator hole 98 also has a tapered section 102. The flow regulator hole 98 has a second internal dimension 104, with the second internal dimension being less than the first internal dimension.

The tapered section 102 of the flow regulator hole is continuous from the first internal dimension to the second internal dimension. The flow regulator hole 98 runs through the base plate from the outward right side of the base plate 74 to the inward left side of the base plate 76. The inward left side flow regulator hole has the second internal dimension.

The flow regulator hole 98 of the reservoir base has an associated flow regulator 104. The flow regulator 104 has a threaded outward end 106 having a first external dimension, with a retention clip groove 108, having an associated retention clip 110. The flow regulator 104 has a plurality of o ring grooves 112, with associated o rings 114. The flow regulator has a right outward end 116. The first external dimension thread of the flow regulator 104 being sized to mate with and be threadedly received within the right outward end thread of the flow regulator hole 98. The flow regulator 104 has a middle section 118, with the middle section having an external diameter configured as a taper, with the taper of the middle section sized to fit within the taper internal dimension of the flow regulator hole. The flow regulator hole 98 has an inward left end 120 which has a second internal dimension. The second external dimension of the flow regulator is sized to fit within the second internal dimension of the flow regulator hole. The second external dimension of the flow regulator is less than the first external dimension of the flow regulator.

The fluid reservoir base plate 66 has a pair of fluid path, being a first fluid path 122 and a second fluid path 124. The first fluid path runs from the upper surface of the base plate to the left inward surface of the base plate, thereby forming the base plate first fluid path hole which is located on the left inward surface end 126 of the first fluid path. The first fluid path left inward surface end has an o ring groove with an associated o ring 90. The second fluid path 124 runs from the upper surface of the base plate to the left inward surface of the base plate, thereby forming the base plate second fluid path hole 128 which is located on the left inward surface end of the second fluid path. The second fluid pathway left inward surface end has an o ring groove with an associated o ring 91. The second fluid path meets and joins the flow regulator hole, which allows the regulation of fluid flow through the base plate.

There is a fluid pump 130. The fluid pump has an upper component 132 and a lower component 134. The upper component 132 has an upper surface 136 and a lower surface 138, with a thickness 140 there between. The fluid pump upper component 132 has a plurality of coupling bolt holes 138 there through with associated upper component coupling bolts 139. The fluid pump upper component has a pair of gear shaft holes 142 there through. The lower surface of the fluid pump upper component has a pair of overlapping gear recesses 144. The gear recesses each have an intersecting portion 146.

The lower surface 138 of the fluid pump upper component has a pair of fluid grooves 148. The fluid grooves of the fluid pump upper component lower surface 138 connect to the intersection portion of the gear recesses 146 of the fluid pump upper component lower surface 138 and the first fluid path pickup and delivery hole 149 and the second fluid path pickup and delivery hole 151.

The fluid pump lower component 134 has an upper surface 148 and a lower surface 150, with a thickness 152 there between. The thickness of the fluid pump lower component forms four side edges, being a right side edge 154, a left side edge 156, a forward edge 158, and a rearward edge 160. The fluid pump lower component forward edge 158 and the fluid pump lower component rearward edge 160 each have a communicating fluid shuttle valve hole 162 there through. The fluid shuttle valve hole 162 has a stepped configuration. The fluid shuttle valve hole 162 has an associated fluid shuttle valve 164, with a pair of fluid shuttle valve hole plugs 166. The fluid shuttle valve comprises a pair of opposed springs, a pair of opposed needle valves, a pair of opposed shuttle valve seats, and a centrally located shuttle. Each of the fluid shuttle valve hole plugs has a slot 168 therein. Each fluid shuttle valve hole plug has an associated o ring.

The fluid pump lower component has a plurality of threaded coupling bolt holes 170 there through. Each of the threaded coupling bolt holes of the fluid pump lower component have an associated coupling bolt 172. The fluid pump lower component has a pair of gear shaft holes 174 there through. The lower surface of the fluid pump upper component has a plurality of base plate mounting bolt holes 176 there through.

The fluid pump lower component has a pair of ball check valves 178 comprising a ball seat 180 and a ball 182, for permitting one way flow of fluid through the pump. The check valves are located in fluid pickup and delivery holes 149 and 151. This allows fluid to be drawn into the pump, or pressured from the reservoir into the pump, via the fluid pickup and delivery holes, with the check valves only permitting fluid to enter the pump when the fluid pressure within the reservoir is either greater than or equal to the pressure within the pump, so as to prevent cavitation on the feed side of the gear combination. When the pump pressure increases on one side of the pump gears, the check valve on that side of the pump is pressurized and forced closed. If, on the other side of the pump, the fluid is pulled away from the gears, and the pressure on that side of the gears is lower than the reservoir pressure, such as is present in cavitation, the check valve is pulled open, and fluid enters the pump from the reservoir.

The upper surface of the fluid pump lower component has a pair of lower component shuttle valve delivery fluid path holes 184 there in, with each lower component shuttle valve delivery fluid path hole having an associated linear recess 186. Each of the lower component shuttle valve delivery fluid path holes is continuous with one of the pair of fluid pump lower component shuttle valve delivery fluid paths. The fluid pump lower component shuttle valve delivery fluid paths, being the lower component first shuttle valve delivery fluid path 187 and the lower component second shuttle valve delivery fluid path 189, run from the lower component upper surface to the lower component lower surface and are downwardly directed into the shuttle valve hole 162, and shuttle valve 164.

The fluid path holes of the lower component upper surface 184 communicate through the lower component first fluid path 187 and the lower component second fluid path 189 with the shuttle valve hole 162. The fluid pump lower component lower surface has a pair of fluid path holes, being a fluid pump lower component lower surface first fluid path hole and a 190 and a fluid pump lower component lower surface second fluid path hole 191, with the fluid path holes of the fluid pump lower component lower surface communicating with the shuttle valve hole.

The fluid pump lower component lower surface fluid path holes 190 and 191 are directed in a downward orientation, taking fluid from, and returning fluid to, the shuttle valve 164. Each of the fluid pathway holes of the fluid pump lower component lower surface have an associated o ring 192.

The fluid pump has a pair of rotatably meshing pump gears 194. The pump gears each have a central shaft 196. The central shaft of each of the pump gears being rotatably contained with the gear shaft holes 142 of the fluid pump upper component and the gear shaft holes of the fluid pump lower component 198. The fluid pump meshing pump gears are each contained within one of the overlapping gear recesses 144 of the lower surface of the fluid pump upper component. Each central shaft of the meshing pump gears have a hexagonally configured shaft hole 200 there through. The fluid pump has a hexagonally shaped drive shaft 202. The drive shaft couples one of the meshing pump gears with the motor output shaft.

There is a hydraulic cylinder 204. The hydraulic cylinder has an upper end 206, with an open upper extent 208, and a closed lower end 210 with a piston passageway 212 bottom 214. The hydraulic cylinder open upper end 206 has an internal thread 216. The hydraulic cylinder piston passageway 212 is round and is continuous, running from the open upper extent 208 of the hydraulic cylinder to the closed lower end bottom 214 of the hydraulic cylinder.

The hydraulic cylinder piston passageway 212 has an upper region 218. The closed lower end bottom of the hydraulic cylinder being forms as a solid cylinder base 220. The hydraulic cylinder has a piston passageway wall 222, with the wall having a length.

The piston passageway wall of the hydraulic cylinder has an upper end fluid passageway 224 there in. The upper end fluid passageway runs from a fluid passageway opening 226, which is located in the upper region of the hydraulic cylinder piston passageway, to the cylinder base of the hydraulic cylinder, thereby forming a cylinder base opening 228, where the upper end fluid passageway is operatively coupled to the first fluid path hole 126 of the inward left side of the cylinder mounted reservoir base plate.

The piston passageway of the hydraulic cylinder has a lower end fluid passageway 230 there in, with the lower end fluid passageway running from the bottom of the hydraulic cylinder piston passageway to the cylinder base of the hydraulic cylinder, where the lower end fluid passageway is operatively coupled to the second fluid path hole 128 of the inward left side of the cylinder mounted reservoir base plate. The cylinder base has a single downwardly projected mounting tab 232 with a bolt hole 234 there through. The cylinder base has a pair of reservoir base plate mounting bolt holes 236 which run there through, for coupling the hydraulic cylinder to the cylinder mounted reservoir base plate 66. The hydraulic cylinder reservoir base plate mounting bolt holes are sized to receive the cylinder mounting bolts.

The hydraulic cylinder has an end cap 238. The end cap has a ram shaft aperture 240 there through. The end cap has an external thread 242 which is sized to be threadedly received by the internal thread of the hydraulic cylinder open upper end. The hydraulic cylinder has an associated ram shaft 244. The hydraulic cylinder ram shaft has a lower end 246 with an associated piston 248 coupled thereto. The hydraulic cylinder piston has an associated o ring 250. The ram shaft passes through the aperture of the end cap. The ram shaft has an upper end with a mounting hole 252 there through.

In operation a current is delivered to the motor, which turns the motor shaft, and, in turn, rotates the hexagonal shaft which couples the motor and the meshed gears, turning the gears inside of the pump.

The gears in meshed, so the turning of the drive gear in one direction, turns the other gear in an opposite direction. If the drive gear turns in a clockwise direction, the other gear turns in a counter clockwise direction.

In the case of a dry start-up, with the drive gear rotating in a counterclockwise direction, the gears move air in the pump through the upper component recess. This causes a negative pressure in the pump, and the hydraulic fluid is drawn up the first pick up hole 149 check valve 178 on the lower surface of the lower pump component. The fluid is drawn through the groove 148 of the upper component, lower surface, of the pump and into the gear recess. The gears then push the fluid in the direction of rotation and each gear delivers the fluid to the opposite side of the pump, causing the pressure to build on the opposite side, thereby causing the fluid to move down the second fluid path hole 189. The fluid travels through second fluid path 189 to the shuttle valve, where the pressure building up on one side of the valve shifts the valve so that the fluid flow is determined to be in one direction. The fluid exits the shuttle valve hole 191 and the fluid enters the base, being directed through the second fluid path of the base, into the hydraulic cylinder, where the piston is either moved in an upward direction.

As the cylinder piston 248 moves upward, the air in the cylinder is compressed and then displaced. The compressed air moves through the opening in the upper portion of the cylinder wall 226 and into the first fluid path through the cylinder wall 224, into the base plate first fluid path 122. The pressurized air moves through the base plate to the lower surface of the lower component of the pump, where it enters the pump shuttle valve, which has been moved to allow fluid to enter the second fluid path. The shuttle valve allows the air to move through the valve and into the pump lower component first fluid path 187, into the gear recess. The fluid being delivered into the gear recess pushes the air outward, toward the ball check valve, which allows air to move through the closed ball valve, into the reservoir, thereby bleeding the cylinder and pump of air.

When the system is bled of air, the returning fluid would not move through the check valve, but would be used to load the gear pump with fluid, essentially acting as a charging system for the fluid pump.

The non fluid pressurized fluid path allows fluid to return back through the cylinder fluid path, to the base and upward, into the shuttle valve, where it is directed upwards to the lower surface of the pump. The check valve in the pump allow the fluid in the pump to be equalized with the return fluid pressure in the pump. The returning fluid also helps load the pump gear with fluid, thereby enhancing the intermeshed gear pump efficiency.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

In use, the single mounting tab allows the hydraulic pump to be installed or removed without having to depressurize the pump, or compress the cylinder. In two mounting tab devices, the pump has to be lifted off of the mounting member to facilitate removal. With a single mounting tab, the pump can be simple pulled from the mount, without having to move the cylinder ram so as to allow upward or downward movement of the pump during removal. This provides an advantage in mounting situations where space is limited, and such movement might be not easily accomplished. The tab secures the pump in location and provides a direct line of force for the operation of the hydraulic cylinder.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A hydraulic cylinder assembly having a motor and pump, comprising, in combination:

a motor having a housing, with the motor housing having an upper extent and a lower extent, the motor housing having a pair of mounting bolt holes there through, the motor having an output shaft, with the motor output shaft having an upper end and a lower end, with the lower end of the motor output shaft having a hexagonally shaped recess therein;

a power source operatively coupled to the motor;

a hydraulic fluid reservoir having a front wall and a rear wall and a right side wall and a left side wall, the front wall being continuous with the right side wall and the left side wall, the rear wall being continuous with the left side wall and the right side wall, the walls collectively forming a fluid holding volume therein, the hydraulic fluid reservoir being operatively coupled to the motor;

a cylinder mounted reservoir base plate having a rectilinear configuration, the cylinder mounted reservoir base plate having an upper surface and lower surface with a thickness there between, the thickness of the cylinder mounted reservoir base plate forming a peripheral edge, the peripheral edge of the cylinder mounted reservoir base plate having an outward right side and an inward left side and a front side and a rear side, the inward left side having a pair of fluid path holes therein, being a first fluid path hole and a second fluid path hole, with each fluid path hole having an associated o ring, the cylinder mounted reservoir base plate having a pair of fluid paths being a first fluid path and a second fluid path, the first fluid path running from the upper surface of the cylinder mounted reservoir base plate to the left inward surface of the cylinder mounted reservoir base plate thereby forming a left inward surface end of the first fluid path and the first fluid path hole, the second fluid path running from the upper surface of the cylinder mounted reservoir base plate to the left inward surface of the cylinder mounted reservoir base plate thereby forming a left inward surface end of the second fluid path and the second fluid path hole, the cylinder mounted reservoir base plate being coupled to the hydraulic fluid reservoir;

a fluid pump having an upper component and a lower component, the upper component having an upper surface and a lower surface with a thickness there between, the fluid pump upper component having a plurality of coupling bolt holes there through, the fluid pump upper component having a pair of gear shaft holes there through;

the fluid pump lower component and the fluid pump upper component being coupled, the fluid pump lower component having an upper surface and a lower surface with a thickness there between, the thickness of the fluid pump lower component forming four side edges being a right side edge and a left side edge and a forward edge and a rearward edge, the fluid pump lower component having a pair of gear shaft holes there through, the upper surface of the fluid pump lower component having a pair of lower component fluid path holes there in, with each lower component fluid path hole having an associated linear recess, the fluid pump lower component lower surface having a pair of downwardly directed fluid path holes each of which are continuous with one of the fluid pump lower component upper surface fluid path holes;

the fluid pump having a pair of rotatably meshing pump gears, the pump gears each having a central shaft, with the central shaft of each of the pump gears being rotatably contained within the gear shaft holes of the fluid pump upper component and the gear shaft holes of the fluid pump lower component; and a hydraulic cylinder having an upper end with an open upper extent and a closed lower end with a piston passageway having a bottom, the hydraulic cylinder piston passageway being round and running from the open upper extent of the hydraulic cylinder piston passageway to the closed lower end bottom of the hydraulic cylinder piston passageway, the hydraulic cylinder piston passageway having an upper region, the hydraulic cylinder having a piston passageway wall having a length, the piston passageway wall of the hydraulic cylinder having an upper end fluid passageway there in with the upper end fluid passageway running from a fluid passageway opening being located in the upper region of the hydraulic cylinder piston passageway to a cylinder base of the hydraulic cylinder thereby forming a cylinder base opening, the upper end fluid passageway is operatively coupled to the first fluid path hole of the inward left side of the cylinder mounted reservoir base plate, the piston passageway of the hydraulic cylinder having a lower end fluid passageway there in with the lower end fluid passageway running from the bottom of the hydraulic cylinder piston passageway to the cylinder base of the hydraulic cylinder, the lower end fluid passageway is operatively coupled to the second fluid path hole of the inward left side of the cylinder mounted reservoir base plate, the cylinder base having a single downwardly projected tab with a bolt hole there through, the hydraulic cylinder having an associated ram shaft, the ram shaft having a lower end with an associated piston coupled thereto, the ram shaft passing through an aperture of an end cap, the ram shaft having an upper end with a mounting hole there through, the hydraulic cylinder being coupled to the cylinder mounted reservoir base plate.

2. The hydraulic cylinder assembly having a motor and pump as described in claim 1, further comprising:

the lower surface of the fluid pump upper component having a pair of overlapping gear recesses, with the gear recesses having an intersecting portion;

the fluid pump meshing pump gears being contained within the overlapping gear recesses of the lower surface of the fluid pump upper component;

the hydraulic cylinder end cap having an external thread sized to be received by an internal thread of the hydraulic cylinder open upper end; and the closed lower end bottom of the hydraulic cylinder being formed as a solid cylinder base.

3. The hydraulic cylinder assembly having a motor and pump as described in claim 2, further comprising:

the hydraulic fluid reservoir having an open upper end with an upper flange, the hydraulic fluid reservoir having an open lower end with the lower end of the hydraulic fluid reservoir having a lower flange;

the cylinder mounted reservoir base plate having a flow regulator hole there through with the flow regulator hole of the reservoir base having an associated flow regulator;

the fluid pump lower component having a forward edge and rearward edge with the forward edge and rearward edge each having a communicating fluid shuttle valve hole there through, with the fluid shuttle valve hole having an associated fluid shuttle valve with a pair of associated fluid shuttle valve hole plugs, the fluid shuttle valve being contained with the fluid pump lower component fluid shuttle valve hole;

the fluid pathway holes of the fluid pump lower component lower surface communicating with the shuttle valve hole; and the hydraulic cylinder open upper end having an internal thread.

4. The hydraulic cylinder assembly having a motor and pump as described in claim 3, further comprising:

the upper flange of the hydraulic fluid reservoir having a pair of motor mounting bolts which pass through the motor housing and couple the motor to the upper flange of the hydraulic fluid reservoir;

the flow regulator hole running through the reservoir base plate from the outward right side of the base plate to the inward left side of the base plate;

the fluid shuttle valve hole having a stepped configuration;

the fluid pump lower component having a plurality of base plate mounting bolt holes there through;

the first fluid path left inward surface end having an o ring groove with an associated o ring; and the second fluid path left inward surface end having an o ring groove with an associated o ring.

5. The hydraulic cylinder assembly having a motor and pump as described in claim 4, further comprising:

the inward left side of the cylinder mounter reservoir base plate having a pair of threaded bolt holes there in with a pair of associated cylinder mounting bolts;

the lower surface of the fluid pump upper component having a pair of fluid grooves, the fluid grooves of the fluid pump upper component lower surface being continuous with the intersection portion of the gear recesses of the fluid pump upper component lower surface;

each central shaft of the interlocking pump gears having a hexagonally configured shaft hole there through, with the fluid pump having a hexagonally shaped drive shaft, the drive shaft coupling one of the interlocking pump gears with the motor output shaft; and the hydraulic cylinder base having a pair of reservoir base plate mounting bolt holes running there through for coupling the hydraulic cylinder to the cylinder mounted reservoir base plate.

6. The hydraulic cylinder assembly having a motor and pump as described in claim 5, further comprising:

the upper flange of the hydraulic fluid reservoir having a pair of threaded motor mounting bolt holes there in for coupling the motor to the upper flange of the hydraulic fluid reservoir;

the lower flange of the hydraulic fluid reservoir having four corners with each of the four corners of the hydraulic fluid reservoir lower flange having an attachment bolt hole there through;

the flow regulator hole commencing at the outward right side of the base plate; and each of the fluid pathway holes of the fluid pump lower component lower surface having an associated o ring.

7. The hydraulic cylinder assembly having a motor and pump as described in claim 6, further comprising:

the flow regulator hole having a partially threaded first internal dimension, the flow regulator hole having a second internal dimension, with the second internal dimension being less than the first internal dimension;

the fluid pump lower component having a plurality of threaded coupling bolt holes there through, with each of the threaded coupling bolt holes of the fluid pump lower component having an associated coupling bolt for coupling the fluid pump upper component to the fluid pump lower component; and the hydraulic cylinder reservoir base plate mounting bolt holes being sized to threadedly receive the cylinder mounting bolts; and the hydraulic cylinder having an end cap, with the end cap with an aperture there through.

8. The hydraulic cylinder assembly having a motor and pump as described in claim 7, further comprising:

the right side wall of the reservoir having a fill plug opening with an associated fill plug;

each hydraulic fluid reservoir lower flange bolt hole having an associated lower flange bolt;

the inward left side of the base plate having a mounting stud protruding from a mounting stud hole in the base plate, with the mounting stud having an associated o ring, the base plate having four threaded mounting bolt holes there through which are sized to threadedly receive each of the four lower flange bolts, the base plate threaded mounting holes running from the upper surface of the reservoir base plate to the lower surface of the reservoir base plate;

the flow regulator hole also having a tapered section, with the taper of the flow regulator hole running from the first internal dimension to the second internal dimension;

each of the fluid shuttle valve hole plugs having a slot therein, with each fluid shuttle valve hole plug having an associated o ring; and the flow regulator having a middle section with the middle section having an external diameter configured as a taper with the taper of the middle section sized to fit within the taper internal dimension of the flow regulator hole.

9. The hydraulic cylinder assembly having a motor and pump as described in claim 8, further comprising:

the flow regulator hole running through the base plate from the right outward side of the base plate to the left inward side of the base plate, with the inward left side flow regulator hole having the second internal dimension;

the flow regulator having a threaded outward end with a retention clip groove having an associated retention clip, the flow regulator having a plurality of o ring grooves with associated o rings; and the flow regulator hole having an inward left end having a second external dimension, the second external dimension of the flow regulator being sized to fit within the second internal dimension of the flow regulator hole, with the second external dimension of the flow regulator being less than the first external dimension of the flow regulator.

10. The hydraulic cylinder assembly having a motor and pump as described in claim 9, further comprising the flow regulator having a right outward end having a first external dimension with a thread, the first external dimension thread being sized to mate with and be threadedly received within the right outward end thread of the flow regulator hole.

* * * * *